United States Patent [19]

Kaupat

[11] Patent Number: 4,556,006

[45] Date of Patent: Dec. 3, 1985

[54] KAYAK STEERING SYSTEM

[76] Inventor: Peter H. Kaupat, 10013 - 51st Ave. SW., Seattle, Wash. 98146

[21] Appl. No.: 507,782

[22] Filed: Jun. 24, 1983

[51] Int. Cl.[4] ..... B63H 25/38

[52] U.S. Cl. ..... 114/162; 114/144 R; 114/144 A; 114/347

[58] Field of Search ..... 114/144 R, 144 A, 162, 114/347, 146, 165, 153; 441/74

[56] References Cited

U.S. PATENT DOCUMENTS

| | | | |
|---|---|---|---|
| 282,853 | 8/1983 | Davis | 114/347 |
| 1,134,919 | 4/1915 | Sicklesteel | 114/144 R |
| 1,785,971 | 12/1930 | O'Connor | 114/144 R |
| 2,470,137 | 5/1949 | Brown | 114/144 R |
| 2,912,877 | 11/1959 | Rohrer | 114/153 |
| 3,199,485 | 8/1965 | Snider | 114/165 |
| 3,574,900 | 4/1971 | Emery | 114/218 |
| 3,921,561 | 11/1975 | Arce | 114/165 |
| 4,236,476 | 12/1980 | Solf | 441/74 |
| 4,331,093 | 5/1982 | Moller | 441/74 |

FOREIGN PATENT DOCUMENTS

| | | | |
|---|---|---|---|
| 1147212 | 5/1983 | Canada | 114/162 |

*Primary Examiner*—Trygve M. Blix
*Assistant Examiner*—C. T. Bartz
*Attorney, Agent, or Firm*—Delbert J. Barnard

[57] ABSTRACT

A kayak steering apparatus for controlling kayak weathercocking during operation in side wind conditions. An elastomeric line in tension and a non-elastic control line are each attached to opposite side arms of a vertically pivoting rotor which is mounted to the stern of a kayak, with the rotor further being connected to a rudder. A kayak operator can, by hand, pull on or release the control line which acts in combination with tension in the elastomeric line to turn the rotor and thereby set rudder angular position. For setting vertical depth, the rudder is connected to the rotor by a pin which allows the rudder to pivot about a generally horizontal axis. Depth adjustment is also hand controllable by pulling or releasing a line connected to the upper portion of the rudder at a location offset from the horizontal axis defined by the pivoting pin.

12 Claims, 5 Drawing Figures

KAYAK STEERING SYSTEM

TECHNICAL FIELD

This invention relates to kayak steering systems, and in particular to a hand-controlled rudder apparatus mountable onto the stern of a kayak and operable by one hand of the paddler for eliminating weathercocking during kayak use in side wind conditions.

BACKGROUND ART

Paddling a kayak in open water when there are side wind conditions will generally cause the kayak to veer into the direction of the wind. This phenomenon is commonly called weathercocking. Since paddling a kayak requires a large amount of strenuous activity on the part of the paddler, weathercocking is undesirable because it forces the paddler to expend additional energy for making course adjustments.

The degree of weathercocking depends on such various factors as wind angle, the shape and profile of the kayak's hull, kayak load distribution, the amount of hull side-slip which is governed by wind force and hull draft, and the size of the bow wave which varies with kayak cruising speed and the depth of the water in which it is being operated.

The sole effective method known for controlling kayak weathercocking is to use a rudder steering system which has a rudder mounted to the kayak's stern. Previous to the present invention, rudder steering systems have employed foot controls located in the forward portion of the kayak for adjusting the rudder. Although this is an admittedly convenient means for steering in that a kayak paddler is allowed to control the rudder with his feet, leaving both hands free for paddling, there are some inherent disadvantages associated with foot controls.

One disadvantage is that a foot controlled rudder requires movable foot pedals. Movable foot pedals, by their very nature, do not provide good foot support for the paddler which is an important consideration in regard to paddler safety. For example, in the event of a kayak capsizing during operation, it is important for the paddler to have a solid foot support in order to perform an eskimo roll, which is a manuever that puts the kayak back in an upright position. Movable foot pedals make this manuever very difficult, especially for inexperienced paddlers.

A second disadvantage to foot pedals is that they require mechanical linkage structure for joining them to the rudder. Such linkage structure is subject to a risk of failure. This is highly undesirable in that many kayaks are used for touring in remote areas where mechanical breakdowns can put the paddler in a potentially dangerous situation.

Another disadvantage to foot pedals is that a beginning paddler tends to rely on their convenience, and therefore fails to develop good paddling skills. Sometimes, even though a kayak has a rudder steering system, good paddling skills are a necessity when operating in rough sea and wind conditions, or in bad rip tide situations. Foot pedals give the beginner a false sense of security which can result in him getting into unsafe water conditions without having properly developed skills for keeping out of danger.

Having a rudder and associated foot controls is very convenient because it allows the paddler to steer the kayak while devoting all of his energy to paddling.

However, as is clear from the disadvantages described above, a foot controlled rudder sacrifices safety for the sake of convenience. Because of this, kayak designers have made several attempts to solve the weathercocking problem by using special rudderless kayak designs that eliminate any need for foot controlled rudders. Such designs have included increasing the draft of the kayak, adding tracking surfaces to the hull by using concave entry/exit water lines, adding keel lines to the hull, and constructing movable seats as a means for shifting the paddlers weight and thereby adjusting kayak trim. All of these methods have been found to have obvious drawbacks. For example, increasing draft and adding tracking surfaces result in reverse curvatures in a hull's surface that create additional drag and thereby require additional paddling energy for propelling the kayak. Having concave entry/exit water lines causes a loss of bow and stern buoyancy which makes a kayak suseptible to nose diving in certain weather conditions. Distinctive keel lines lessen kayak maneuverability which can be dangerous in bad weather or where there is turbulent water conditions. Movable seats are undesirable in that they add structure to the kayak which is subject to mechanical failure, with the added structure further increasing kayak weight thereby having an effect on drag. In addition, their adjustability is limited by the size of the kayak cockpit, which by necessity is small. Therefore, movable seats are not an effective means for adjusting trim. Rudderless kayak designs have neither provided a safe nor adequate solution to the weathercocking problem.

Consequently, the main object of the present invention is to eliminate foot controlled rudder systems by providing a safe, hand controlled system. This in turn eliminates the safety and design problems described above.

Another object of the invention is to provide an uncomplicated hand controlled means for controlling a rudder that can be used by a kayak paddler with a minimum interruption in paddling motion.

A further object of the invention is to provide a hand controlled kayak steering system that is interchangeable with foot controlled steering systems. This will allow the paddler to opt for the convenience of foot controls when paddling in fair weather conditions.

DISCLOSURE OF THE INVENTION

A kayak steering system embodying the present invention basically comprises a rudder which is mountable onto the stern of a kayak, for pivotal movement about a vertical axis. A spring means provided on one side of the kayak normally biases the rudder into a first maximum angle turning position. A control line provided on the opposite side of the kayak is operable for moving the rudder between said first maximum angle turning position and a second maximum turning position in the opposite direction.

Preferably, an anchor means for the forward end of the control line is positioned on the kayak in easy reach of the kayaker. Owing to this arrangement, the kayaker can, with one hand, detach the control line from the kayak, then pull on or relax the control line to reposition the rudder, and then reattach the control line to the kayak.

Accordingly, a basic object of the invention is to provide a control line which acts in combination with tension in the spring means to set rudder position.

In preferred form, a rearward portion of the spring means is attached to the tiller and a forward portion of the same is anchored to the kayak by an adjustable fastener. The fastener enables the kayak operator to adjustably attach or detach the spring means so that tension in the elastomeric portion can be adjusted. Preferably, the adjustable fastener is located on the kayak in a position where it is in easy reach of a hand of the kayak operator. Preferably also, the control line has a rearward portion attached to the other side of the tiller and a forward portion also anchored to the kayak by means of an adjustable fastener. The adjustable fastener anchoring the control line is also located in a position that is in easy reach of the kayak operator's hand.

Another aspect of the invention is that the tiller includes a rotor portion having a first side arm for connecting to a spring means line, and a second side arm for connecting to a control line. The rotor has a block body with a forward face formed to include a horizontal slot extending the entire transverse width of the block. The slot snugly receives a central portion of an elongated tiller bar. This tiller bar has end portions which project outwardly from the two sides of the block body in such a manner so as to act as first and second side arms of the tiller. The forward face of the block further includes a vertical opening extending through its entire vertical height with this opening intersecting the slot. This opening is coaxially aligned with another vertical opening in the tiller bar so that a mounting pin can be received extending downwardly through the block body and the tiller bar to a mounting support in the stern of the kayak. This allows the mounting pin to define the vertical axis about which the tiller pivots.

In accordance with another aspect of the invention, the block body of the tiller also has a rearward portion wherein is located a bore that receives a horizontal pivot pin. This pivot pin connects the rudder connecting frame to the tiller. The frame has an open "Y" shape. It has a branched forward end made out of two laterally spaced apart arm members, the arms converging to a closed rearward end connected to the rudder. The pin connects the forward end of the frame to the block body thereby enabling the rudder and frame to pivot generally about a horizontal axis defined by the pin. This allows the depth of the rudder to be adjusted which further allows the invention to act as a dually adjustable keel, i.e. not only can angular direction of the rudder be varied, but the wet surface of the rudder can be varied as well. If the boat weathercocks upwind, the rudder can be lowered in order to make the stern of the kayak harder tracking. Conversely, if the boat weathercocks downwind, the rudder can be raised thereby reducing stern tracking.

A rudder depth control line having an after end attached to the rudder and a forward end extending to an adjustable fastener on the kayak provides a means for adjusting rudder depth. Much like the spring means and control line attached to the tiller arms, the rudder depth control line has a forward portion anchored by an adjustable fastener in easy reach of the hand of a kayak operator. Pulling or releasing the line enables rudder depth adjustment.

In accordance with a further aspect of the invention, the tiller and rudder connecting frame are preferably mounted to the stern of a kayak by a mounting pin which extends downwardly through an opening in the tiller where it is received by a bushing that is inset into the stern. This bushing includes a vertical passageway for receiving the mounting pin and has a lock shoulder located at the bottom of the passageway. The end of the pivot pin has at least one laterally extending lock element and when the lock element is extended, it will be positioned below the lock shoulder of the bushing. This prevents axial removal of the pivot pin from the bushing. The pin further has a movable control element, in the form of a depressable button, connected to the lock elements which serves as a means for retracting the lock element or lock elements. Moving this control element retracts a lock element so that the mounting pin can be withdrawn from the passageway in the bushing. Thus, the pivot pin can easily be attached or detached from the bushing, which in turn allows for easy attachment and detachment of the tiller to and from the stern of the kayak.

Other more detailed features of the invention are described in the description of the preferred embodiment and are particularly pointed out in the appended claims.

BRIEF DESCRIPTION OF THE DRAWINGS

Referring to the accompanying drawings which are for illustrative purposes.

DESCRIPTION OF THE PREFERRED EMBODIMENT

Figure 1:
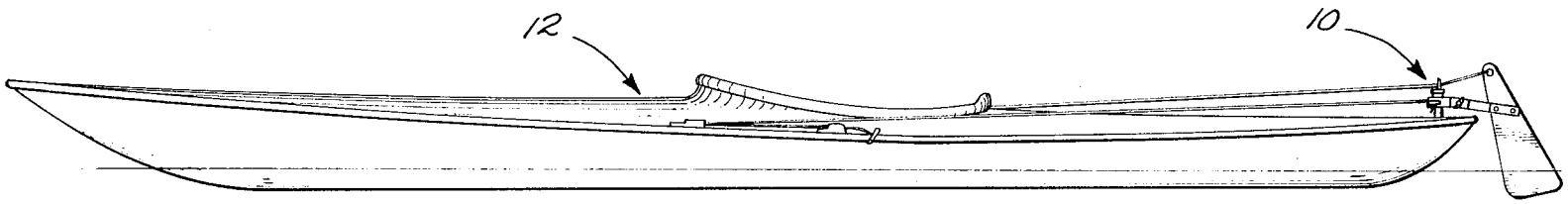
FIG. 1 is a side elevational view of the port side of a kayak having a preferred embodiment of the invention mounted rearwardly on the stern.

Referring now to the drawings, FIG. 1 shows generally a kayak steering system 10 mounted onto the stern of a kayak 12. Direction attention to FIG. 2, details of the preferred embodiment of this invention are shown.

Figure 2:
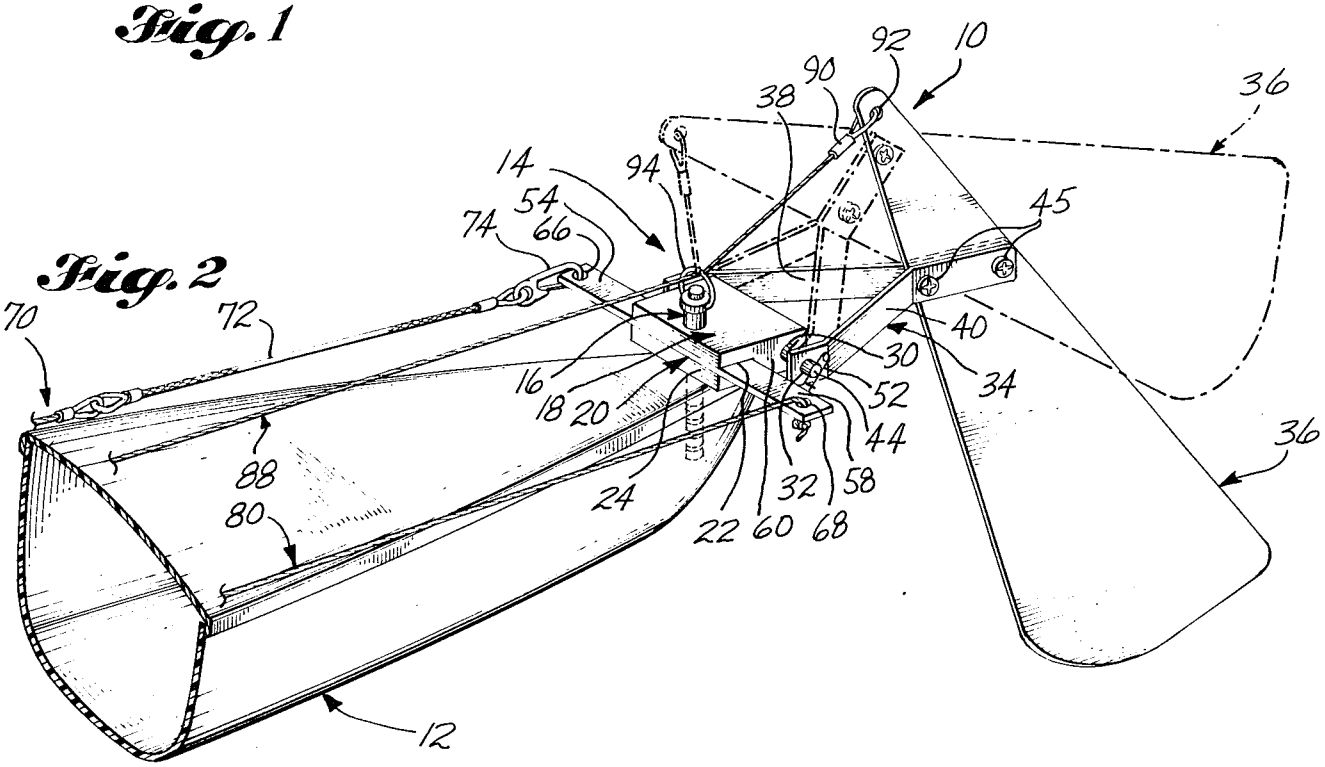
FIG. 2 is a detailed pictorial view of the stern portion of the kayak in FIG. 1 shown as being cutaway aft of the cockpit. The invention is shown pivotally mounted to the stern so that is can rotate about a generally vertical axis. Further, the figure shows the invention having a rudder that can pivot about a generally horizontal axis thereby enabling adjustment of rudder depth.
Figure 3:
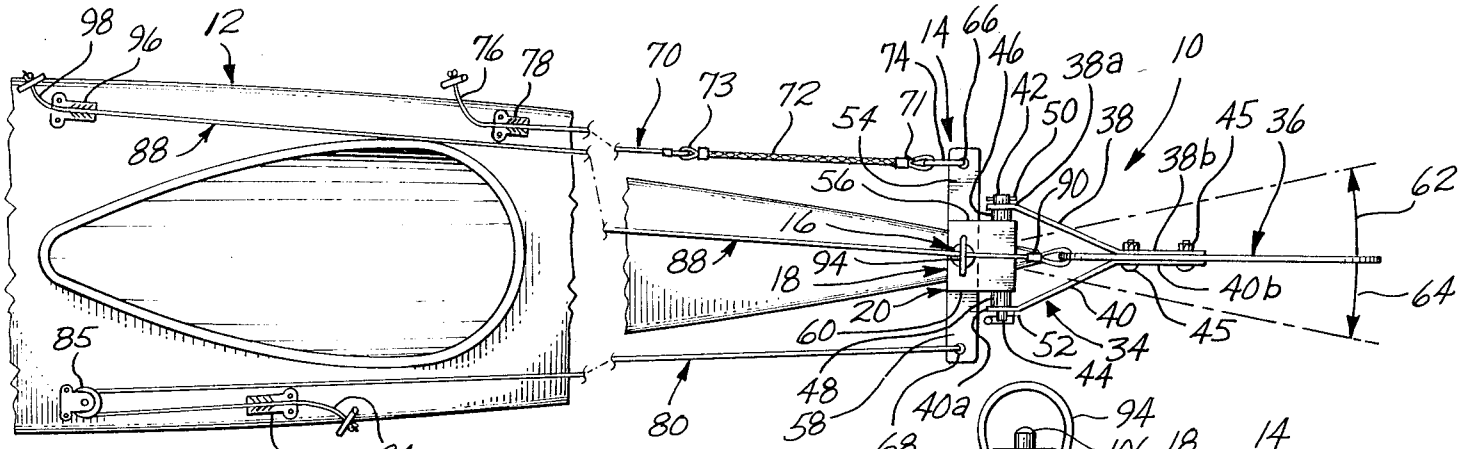
FIG. 3 is a fragmented top plan view of the kayak in FIG. 1, showing a portion of the kayak where the cockpit is located, and also showing the stern portion of the kayak with the invention pivotally mounted to it.
Figure 4:
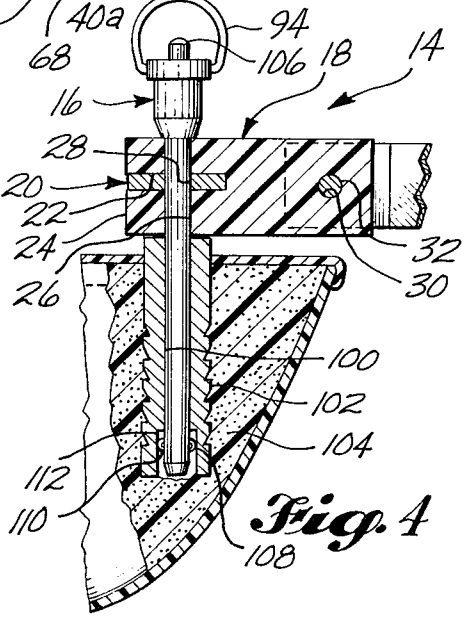
FIG. 4 is a vertical cross-sectional view of the stern portion of the kayak, showing the method by which the invention is pivotally mounted.

The steering system is composed of a tiller apparatus 14, hereinafter referred to as the tiller 14, mounted to the stern of the kayak by means of a mounting pin 16. The pin 16 enables the tiller 14 to pivot about a generally vertical axis relative to the stern. The tiller 14 has a rotor portion composed of a generally rectangular shaped block 18 and a straight, elongated cross member 20. The block 18 serves as a frame for connecting together the various components of the tiller. It has a continuous horizontal slot 22 located in its forward face 24. This slot 22 extends through the entire transverse width of face 24 and is centrally located therein relative to the vertical height of the block 18. The forward portion of the block 18 also has a bore 26 centrally located relative to the transverse width of the block. As is shown in FIG. 4, this bore 26 intersects the cavity defined by the horizontal slot 22. The bore 26 is continuous and has a uniform diameter. It extends down through the height of the block 18 in order to allow the mounting pin 16 to extend downwardly therethrough. The bore communicates with the mounting pin in order to allow the tiller to pivot generally about the vertical axis defined by the pin. Keeping attention directed to FIG. 4, and as is also shown in FIGS. 2 and 3, the central portion of cross member 20 fits into slot 22. The cavity defined by slot 20 is sized appropriately in order to slidably receive a central portion of cross member 20.

Cross member 20 is held in place by the mounting pin 16 which in addition to extending down through bore 26, also extends through bore 28 in the cross member. Bore 28 has a radius essentially equal in length to the radius of bore 26 and must be coaxially aligned therewith so that the cross member 20 can be fitted into the slot 22 and held in place by the mounting pin 16.

The rearward portion of block 18 has a horizontal bore 30 for receiving a frame connecting pin 32. FIGS. 2 and 3 shown pin 32 connecting frame 34 and rudder 36 to the block. Frame 34 is essentially an open "Y" frame having two laterally opposing arm members 38 and 40. Each arm member has a straight portion 38A and 40A, best seen in FIG. 3, connected to pin ends 42 and 44, respectively. The arms converge rearwardly to straight portions 38B and 40B. These two straight portions are substantially parallel, but located adjacent opposite sides of the upper portion of rudder 36. Straight portions 38B and 40B are connected together by bolts 45, with the upper portion of the rudder sandwiched in between. When this connection is made, a frame and rudder assembly is formed, composed of arms 38 and 40, and rudder 36.

In order to connect the frame and rudder assembly to the tiller, bores in arms 38 and 40 are positioned coaxially relatively to horizontal bore 30. Hollow cylindrical spacers 46 and 48 are placed in the gaps between frame straight portions 38A, 38B and block sides 56, 60, respectively. The spacers have bores that are coaxially aligned with bore 30 and the bores in straight portions 38A and 38B. Having this configuration, connecting pin 32 can then be inserted through the bore in one of the frame straight portions, extended through spacers 46, 48 and bore 30, and then extended outwardly through the bore in the other frame straight portion. Connecting pin 32 is of sufficient length such that when it is in position pin ends 42 and 44 will project outwardly from straight portions 38A and 40A, respectively. Pin 32 and frame 34 are held together in place by means of spring-clip or cotter pins 50 and 52 which are inserted into pin ends 42 and 44, respectively. With frame 34 connected to pin 32 in this manner, the rudder and frame assembly is free to pivot about a transverse axis defined by inserting pin 32 so that rudder depth can be adjusted.

As previously described, the central portion of cross member 20 is slidably received in horizontal slot 22, and is held in place by mounting pin 16 which extends downwardly through bores 26 and 28. Referring now to FIGS. 2 and 3, it is shown that cross member 20 has a first end 54 which extends outwardly from slot 20, projecting laterally from and substantially perpendicular to side 56 of the block 18. Cross member 20 also has a second end 58 which extends outwardly from the opposite end of slot 20, projecting laterally from and substantially perpendicular to side 60 of the block 18. With ends 54 and 58 extending outwardly in this manner, the combination of the block, cross member, and mounting pin act as the rotor portion of the tiller. Pivoting the rotor about the axis defined by the mounting pin will cause the rudder to move generally according to the directions indicated by arrows 62 and 64 in FIG. 3. Therefore, kayak directional control can be achieved by applying pivoting forces to ends 54 and 58 which move the rudder to a particular desired position.

Figure 5:
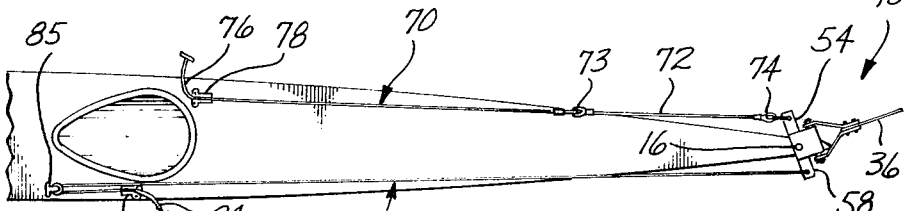
FIG. 5 is a fragmented top plan view of the kayak and invention in FIG. 1, showing the kayak with a forward portion cut off.

Pivoting forces are applied to the rotor by an elastomeric line, hereinafter referred to as the spring means line 70, operating in combination with a control line 80. This arrangement is best shown in FIG. 5. End 54 acts as a first side arm enabling rotor connection to the spring means line, and end 58 acts as a second side arm enabling rotor connection to the control line. Apertures 66 and 68 in ends 54 and 58 (see FIGS. 2 and 3) enable connection of the spring means and control line, respectively.

Tension in the spring means line 70 exerts a force on end 54 in a forward direction relative to the stern of the kayak. This force will pivot steering system 10 about the vertical axis defined by mounting pin 16 to the position shown generally in FIG. 5. The force exerted by spring means line 70 is balanced by a counter-force exerted on end 58 by the control line 80. At all times there is a sufficient force and counter-force in both spring means line 70 and control line 80 to hold the rudder 36 in a stationary position with a minimum amount of wobble.

The spring means line 70 is composed of essentially a line having a rubber bungee cord 72 integrated as a portion thereof, as shown in FIGS. 2, 3, and 5. Spring means line 70 is connected to aperture 66 by a latch 74. This latch is easily detachable from the aperture enabling easy placement and removal of the spring means line to and from the tiller. The purpose of this feature is to enable the paddler to switch from a hand controlled steering system, as contemplated by this invention, to a foot controlled system. The bungee cord 72 is connected at one end to latch 74 by means of a loop 71. The other end is attached to spring means line 70 by another loop 73 as shown in FIG. 3.

FIGS. 3 and 5 show a forward end portion 76 of the spring means line 70 attached to the kayak by means of an adjustable fastener, jam cleat 78. This jam cleat is a standard rope cleating device, such as that which is disclosed by U.S. Pat. No. 3,574,900 issued to Emery on April 13, 1971. The advantage to using a jam cleat lies in the fact that it enables the kayak paddler to easily detach forward portion 76, adjust the tension in the bungee cord 72 by pulling on or releasing line 70, and then reattach portion 76 to the cleat 78. This is very convenient for the paddler in that this adjustment can be done quickly, with one hand, and thereby does not interrupt paddling for a long period of time.

Rudder directional control is provided by control line 80. This line is connected at its after end 72 to aperture 68. The connection can be made by using a latch similar to that used for the spring means line 70, or the control line can be tied in place with a knot as shown in FIG. 2. The control line also has a forward portion 84 which runs through a pulley 85 and is attached to the kayak by a second jam cleat 86. This jam cleat 86 is similar to the jam cleat 78 used for the spring means line attachment and is also in easy reach of the paddler's hand.

Steering adjustment is easily performed by detaching forward portion 84 from jam cleat 86. Then, if the control line 80 is released, tension in the bungee cord 72 will pull the rudder in the direction of arrow 62. Alternatively, pulling on the control line 80 will move the rudder in the direction of arrow 64. Once a desired rudder position is achieved, the control line forward portion 84 can be reattached to the jam cleat 86.

Since the control line is nonelastic, it is impossible to change rudder position by adjusting the spring means line. Tension in the spring means line must be set first, with the control line then being used to adjust rudder position. After tension in the spring means line is initially set, it need not be adjusted further other than to compensate for bungee cord deterioration with age. Rudder position is solely controlled by using the control line.

FIGS. 1 and 2 show rudder 36 adjusted at a maximum depth. Depth can be controlled by pulling on or relaxing line 88. This line has an after end 90 connected by a loop to the upper portion of the rudder 36 at aperture 92. The line 88 then extends forwardly through and is guided by a ring 94, connected to the top of mounting pin 16, to a third jam cleat 96 where it is attached as shown in FIG. 3. Jam cleat 96 is in easy reach of the kayak operator, and as with the spring means and rudder control line, rudder depth can be adjusted by merely detaching a forward portion 98 of line 88 from jam cleat 96, pulling on or releasing the line and then reattaching the forward portion. Pulling on the line 88 will raise the rudder 36 to the position shown by the dash-dot-dash lines in FIG. 2. Releasing the line 88 allows the rudder 36 to be set at its maximum depth as shown in FIGS. 1 and 2.

Redirecting attention now to FIG. 4, the means for mounting the steering system 10 to the stern of a kayak will now be described. It was stated earlier that cross member 20 is held in place in slot 22 by pin 16. Pin 16 extends downwardly through both the bore 26 in the block 18 and the bore 28 in the cross member 20 where it is received by another bore 100 in a bushing 102. This bore 100 has a substantially uniform diameter for slidably receiving the pin 16. The bushing is fixed within a support matrix 104.

The support matrix can be made out of a homogeneous plastic foam cement which is integrated and complementarily form-fitted with the structure that composes the stern of the kayak. The matrix is applied to the stern while in an amophorus condition and the bushing is set in place before it hardens. Once the matrix has hardened, the bushing is then firmly inset in the stern, ready for connection of the steering system by the mounting pin.

Mounting pin 16 is held in place in bore 100 by means of laterally extending lock elements or nubs 108 and 110 which project outwardly from the end of the pin below a lock shoulder 112 in the bushing 102. A releasing button 106 located at the top of mounting pin 16 is connected to nubs 108 and 110. The pin 16 can be removed from the bushing 102 and support matrix 104 by depressing button 106 which retracts nubs 108 and 110, thereby allowing the pin to slide out of bore 100. Removing the pin allows detachment of the steering system 10 from the kayak. The steering system can be easily reattached by simply reversing the process just described.

The invention as shown in this preferred embodiment has been designed to facilitate ease of manufacture, and further, the design also provides for ease of assembly and disassembly. The block can be constructed of a durable, lightweight hard plastic. The cross member, frame, and rudder can be constructed from aluminum or some similar lightweight metal. Although it is not critical to the invention that these specific materials be used, it is desirable that all invention components be constructed from materials that are as low in weight as possible. This is because a kayak is limited in its carrying capacity with respect to the combined weight of the paddler and his gear. Therefore, any additional accessories appurtenant to a kayak should be low in weight.

The construction described and illustrated herein as a preferred embodiment of the invention is intended to be merely illustrative and not descriptive in a limiting sense. Many changes could be made without departing from the spirit of the invention as defined by the appended claims, and the scope of the invention is to be limited only by such claims.

What is claimed is:

1. A rudder assembly for a kayak steering system comprising:

a rotor including a first side connectable to a first control line, a second side connectable to a second control line, and a vertical pivot pin receiving opening in said rotor;

a rudder;

means connecting the rudder to the rotor;

pivot pin mounting means comprising a bushing insettable into a stern portion of a kayak, said bushing including an upper end, onto which the rotor sits and turns, a vertical pivot pin receiving passageway and a lock shoulder laterally offset from said passageway, below said upper end;

vertical pivot pin means insertable downwardly through said vertical pin receiving opening in said rotor and said vertical first pin receiving passageway in said bushing, including at least one laterally extending lock element positionable below said shoulder, for preventing unwanted axial movement of the pivot pin means out from said passageway, wherein said vertical pivot pin means includes lock element release means, including an upper end control element movable for withdrawing the lock element from a position below the lock shoulder so that the pivot pin means can be removed out from said passageway.

2. A rudder assembly according to claim 1, wherein said rotor comprises a block body which sits down onto the upper end of said bushing and said vertical pivot pin means comprises an enlarged head portion which is positioned above the block body.

3. A steering system for a kayak which includes a stern and a cockpit spaced forwardly of the stern, said steering system comprising:

a rudder;

a steering and mounting means for the rudder including a tiller, means mounting a tiller onto the stern of the kayak, for pivotal movement about a generally vertical axis, and frame means extending rearwardly from the tiller to the rudder;

a biasing line having an after end connected to the first side of the tiller on a first side of a pivot axis, said biasing line extending forwardly from the tiller to a forward end, said biasing line including an elastomeric section;

first anchor means for attaching a forward end of the biasing line to the kayak, said first anchor means comprising an adjustable fastener in easy reach of the hand of a kayak operator located within said cockpit, said adjustable fastener being operable for adjustably attaching the forward end of the biasing line to the kayak, said line being attached to normally bias the rudder at an angle towards the biasing line side of the kayak;

a control line having an after end connectable to a second side of the tiller on the opposite side of the pivot axis, said control line extending forwardly from the tiller and having a forward end portion; and second anchor means for adjustably attaching the forward portion of the control line to the kayak in easy reach of a hand of an operator seated in the cockpit, so that the operator can, with one hand, detach the control line from the kayak, pull on or relax the control line to cause movement of the rudder, and then reattach the control line to the kayak, for setting the position of the rudder.

4. The invention of claim 3, including:

means mounting the rudder for vertical pivotal movement about a horizontal axis;

a rudder control line for adjusting rudder depth, said control line having an afterend connected to the rudder at a location offset from said horizontal axis, and a forward portion; and third anchor means for adjustably attaching the forward portion of the rudder control line to a kayak in easy reach of the hand of an operator so that such operator can, with one hand, detach the rudder control line from the kayak, pull on or relax the rudder control line to adjust rudder depth, and then reattach the same to the kayak.

5. The invention according to claim 3, wherein the means for mounting the tiller onto the stern of a kayak for pivotal movement about a generally vertical axis comprises a vertical opening in the tiller, vertical pivot pin means insertable through said vertical opening about which said tiller pivots, and a bushing insettable into a stern portion of a kayak, said bushing including a vertical pivot pin receiving passageway and a lock shoulder, and said vertical pivot pin means including at least one laterally extending lock element positionable below said shoulder, for preventing unwanted axial movement of the pivot pin means out from said passageway.

6. The invention according to claim 5, wherein said pivot pin means includes lock element release means, including an upper end control element movable for withdrawing the lock element from a position below the lock shoulder so that the pivot pin means can be removed from said passageway.

7. The invention according to claim 6, further including:

means mounting the rudder for vertical pivotal movement about a horizontal axis;

a rudder control line for adjusting rudder depth, said control line having an afterend connected to the rudder at a location offset from said horizontal axis, and a forward portion; and third anchor means for adjustably attaching the forward portion of the rudder control line to a kayak in easy reach of the hand of an operator so that such operator, can with one hand, detach the rudder control line from the kayak, pull on or relax the rudder control line to adjust rudder depth, and reattach the same to the kayak.

8. The invention of claim 7, wherein said pivot pin means includes a ring at its upper end and the rudder control line extends through and is guided by said ring.

9. A rudder/tiller assembly for a kayak steering system comprising:

a rotor including a first side arm connectable to a first control line, a second side arm connectable to a second control line, and a vertical pivot pin receiving opening;

vertical pivot pin means insertable through said vertical opening and detachably connectable to a stern portion of a kayak;

a "Y" shaped rudder mounting frame, having a branched forward end comprising two laterally spaced apart arm members and a rearward rudder mounting end;

means pivotally connecting the arm members to said rotor for pivotal movement about a generally horizontal axis; and means connecting the rudder to the rudder mounting end of said frame.

10. The invention according to claim 9, in which: said rotor comprises a block body having a forward end formed to include a horizontal slot and a vertical opening intersecting said slot, and a rearward end portion to which the arm members are mounted for pivotal movement about a horizontal axis;

an elongated tiller bar snugly received in said horizontal slot and including end portions which project laterally outwardly from the two sides of the block body, to form said first and second side arms, said tiller bar including a vertical opening in coaxial alignment with the vertical opening in the forward end portion of the block body; and wherein said vertical pivot pin means extends through the opening in the tiller bar and connects the tiller bar to the block body.

11. The invention according to claim 9, further including:

pivot pin mounting means comprising a bushing insettable into a stern portion of a kayak, said bushing including a vertical pivot pin receiving passageway and a lock shoulder; and said vertical pivot pin means including at least one laterally extending lock element positionable below said shoulder, for preventing unwanted axial movement of the pivot pin means out from said passageway.

12. The invention according to claim 11, wherein said pivot pin means includes lock element release means, including an upper end control element movable for withdrawing the lock element from a position below the lock shoulder so that the pivot pin means can be removed out from said passageway.

* * * * *